US006866616B2

(12) United States Patent
Sommer

(10) Patent No.: US 6,866,616 B2
(45) Date of Patent: Mar. 15, 2005

(54) DUAL PATH HELICAL RAMP

(76) Inventor: Michael Saunders Sommer, 2401 Pennsylvania Ave., Philadelphia, PA (US) 19130

( * ) Notice: Subject to any disclaimer, the term of this patent is extended or adjusted under 35 U.S.C. 154(b) by 308 days.

(21) Appl. No.: 10/207,567

(22) Filed: Jul. 29, 2002

(65) Prior Publication Data

US 2003/0036466 A1 Feb. 20, 2003

Related U.S. Application Data

(60) Provisional application No. 60/309,935, filed on Aug. 3, 2001.

(51) Int. Cl.[7] ..... A63B 67/00
(52) U.S. Cl. ..... 482/110; 273/112; 40/427
(58) Field of Search ..... 482/110; 273/109, 273/112, 118 R, 120 R; 40/427; 446/168

(56) References Cited

U.S. PATENT DOCUMENTS

| | | | | |
|---|---|---|---|---|
| 3,028,704 A | | 4/1962 | Rumbaugh | 105/340 |
| 3,610,624 A | * | 10/1971 | Fleischer | 273/112 |
| 4,120,501 A | | 10/1978 | Atherton | 273/120 R |
| 4,394,016 A | | 7/1983 | Manos | 273/109 |
| 4,595,369 A | | 6/1986 | Downs | 434/302 |
| 5,358,241 A | | 10/1994 | Anghelo | 273/118 R |
| 5,374,217 A | * | 12/1994 | Olson | 472/57 |

* cited by examiner

*Primary Examiner*—Glenn Richman
(74) *Attorney, Agent, or Firm*—Volpe and Koenig, P.C.

(57) ABSTRACT

A dual path helical ramp consisting of a wire rail formed as a helix, a straight rail, a closed transparent cylindrical wall rail, and a ball. The helical rail extends between a first elevation where the ball enters or exits the ramp to a second, lower elevation where a ball exits or enters the ramp. The straight rail extends through the center of the helical rail for the length thereof. The cylindrical wall rail extends outside of the helical rail for the length thereof. The helical rail is joined at either end of the straight rail and the straight rail is joined at either end of the cylindrical wall rail, thereby forming two elevations. The helical rail is dimensioned such that the distance between it and straight rail and it and wall rail is less than the diameter of the ball. As a result, the ball will contact both helical rail and straight rail, or helical rail and wall rail, simultaneously, as it rolls downward by the force of gravity and upward by taking advantage of the centrifugal force of the ball, using suitable circular movements. Each elevation has sufficient space for the ball to cross from one path to the other, allowing the ball to roll up and down a continuous helical path, along linked concentric interior and exterior paths of the dual path helical ramp, as the device is manipulated about its three-dimensional axes.

13 Claims, 4 Drawing Sheets

DUAL PATH HELICAL RAMP

BACKGROUND OF THE INVENTION

A dual path helical ramp consisting of a wire rail formed as a helix, a straight rail, a closed transparent cylindrical wall rail, and a ball. The helical rail extends between a first elevation where the ball enters or exits the ramp to a second, lower elevation where a ball exits or enters the ramp. The straight rail extends through the center of the helical rail for the length thereof. The cylindrical wall rail extends outside of the helical rail for the length thereof. The helical rail is joined at either end of the straight rail and the straight rail is joined at either end of the cylindrical wall rail, thereby forming two elevations. The helical rail is dimensioned such that the distance between it and straight rail and it and wall rail is less than the diameter of the ball. As a result, the ball will contact both helical rail and straight rail, or helical rail and wall rail, simultaneously, as it rolls downward by the force of gravity and upward by taking advantage of the centrifugal force of the ball, using suitable circular movements. Each elevation has sufficient space for the ball to cross from one path to the other, allowing the ball to roll up and down a continuous helical path, along linked concentric interior and exterior paths of the dual path helical ramp, as the device is manipulated about its three-dimensional axes.

The use of numerous ramps and ball raising and lowering devices is known in the prior art. Usually such devices involve the exercise of some skill and/or manual dexterity to manipulate the device to cause the ball to follow a given passageway and traverse multiple levels which support the rolling ball. More specifically, numerous mechanisms for transferring the ball between the different levels which have been developed are known to consist basically of familiar, expected, and obvious structural configurations, notwithstanding the myriad of designs encompassed by the crowded prior art which have been developed for the fulfillment of countless objectives and requirements.

By way of example:

U.S. Pat. No. 3,028,704 to Rumbaugh discloses a ball and spiral track toy.

U.S. Pat. No. 4,120,501 to Atherton discloses dual path ramp ball game.

U.S. Pat. No. 4,394,016 to Manos discloses a game using the helical movement of a ball or vehicle.

U.S. Pat. No. 4,595,369 to Downs discloses a dual path educational and amusement device.

U.S. Pat. No. 5,358,241 to Anghelo discloses a helical monorail ramp.

However, those heretofore available possesses numerous drawbacks and disadvantages in that the structure allows none, or only limited and superficial variations of complexity: linked concentric interior and exterior paths; alternate paths or routes through rotation; variable ball motion to lower and raise the ball; adjustable level of complexity; and multiple routes with common crossing points.

Therefore, while these devices fulfill their respective, particular objectives and requirements, the aforementioned patents do not offer a dual path helical ramp consisting of a wire rail formed as a helix, a straight rail, a closed transparent cylindrical wall rail, and a ball. The helical rail extends between a first elevation where the ball enters or exits the ramp to a second, lower elevation where a ball exits or enters the ramp. The straight rail extends through the center of the helical rail for the length thereof. The cylindrical wall rail extends outside of the helical rail for the length thereof. The helical rail is joined at either end of the straight rail and the straight rail is joined at either end of the cylindrical wall rail, thereby forming two elevations. The helical rail is dimensioned such that the distance between it and straight rail and it and wall rail is less than the diameter of the ball. As a result, the ball will contact both helical rail and straight rail, or helical rail and wall rail, simultaneously, as it rolls downward by the force of gravity and upward by taking advantage of the centrifugal force of the ball, using suitable circular movements. Each elevation has sufficient space for the ball to cross from one path to the other, allowing the ball to roll up and down a continuous helical path, along linked concentric interior and exterior paths of the dual path helical ramp, as the device is manipulated about its three-dimensional axes.

In this regard, the dual path helical ramp, according to the present invention, substantially departs from the conventional concepts and designs of the prior art.

BRIEF SUMMARY OF THE INVENTION

In the view of the foregoing disadvantages inherent in the known types of maze puzzles now present in the prior art, the present invention provides a new and improved dual path helical ramp and method which has all the advantages of the prior art and none of the disadvantages.

To attain this, the present invention entails a dual path helical ramp consisting of a wire rail formed as a helix, a straight rail, a closed transparent cylindrical wall rail, and a ball. The helical rail extends between a first elevation where the ball enters or exits the ramp to a second, lower elevation where a ball exits or enters the ramp. The straight rail extends through the center of the helical rail for the length thereof. The cylindrical wall rail extends outside of the helical rail for the length thereof. The helical rail is joined at either end of the straight rail and the straight rail is joined at either end of the cylindrical wall rail, thereby forming two elevations. The helical rail is dimensioned such that the distance between it and straight rail and it and wall rail is less than the diameter of the ball. As a result, the ball will contact both helical rail and straight rail, or helical rail and wall rail, simultaneously, as it rolls downward by the force of gravity and upward by taking advantage of the centrifugal force of the ball, using suitable circular movements. Each elevation has sufficient space for the ball to cross from one path to the other, allowing the ball to roll up and down a continuous helical path, along linked concentric interior and exterior paths of the dual path helical ramp, as the device is manipulated about its three-dimensional axes.

The foregoing and other objects which will appear as the nature of the invention is better understood, may be accomplished by a construction, combination and arrangement of parts such as is disclosed by the drawings. The nature of the invention is such as to render it susceptible to various changes and modifications, and therefore is not limited to the construction described by the drawings nor to the particular parts described in the specification.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is neither intended to define the invention of the application, which is measured by the claims, nor is it intended to be limiting as to the scope of the invention in any way.

Therefore, it is an object of the present invention to provide a dual path helical ramp which has all the advantages of the prior art maze puzzles and none of the disadvantages.

It is another object of the present invention to provide a dual path helical ramp which may be easily and efficiently manufactured and marketed.

These together with other objects of the invention, along with the various features of novelty which characterize the invention, are pointed out in the claims forming a part of this disclosure. For a better understanding of the invention, its operating advantages and the specific objects attained by its uses, the accompanying drawings and descriptive matter illustrates the preferred embodiment of the invention.

BRIEF DESCRIPTION OF THE SEVERAL VIEWS OF THE DRAWING

The invention will be better understood when consideration is given to the following detailed description of the annexed drawings:

| | |
|---|---|
| dual path helical ramp | 10 |
| helical rail | 12 |
| straight rail | 14 |
| cylinderical wall rail | 16 |
| interior path | 18 |
| exterior path | 20 |
| first elevation | 22 |
| second elevation | 24 |
| ball | 26 |

Figure 1:
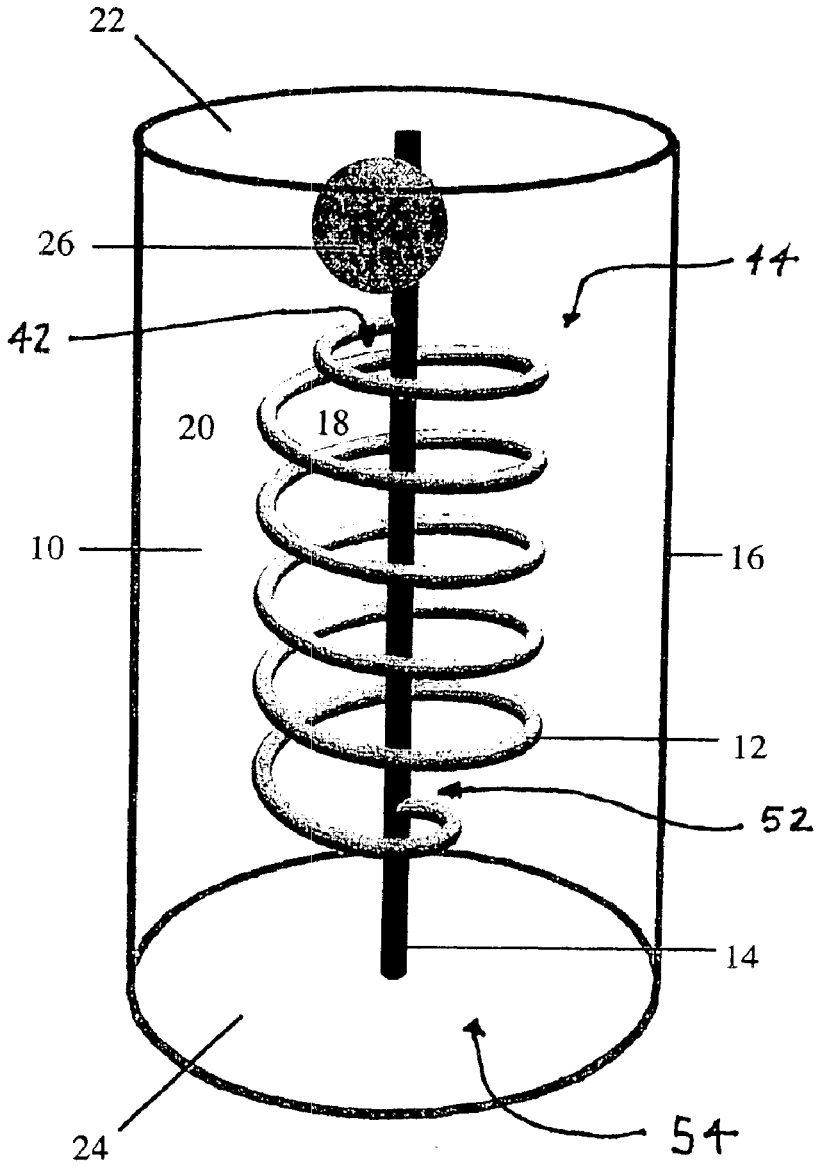

FIG. 1 is a perspective view of the dual path helical ramp.

Figure 2:
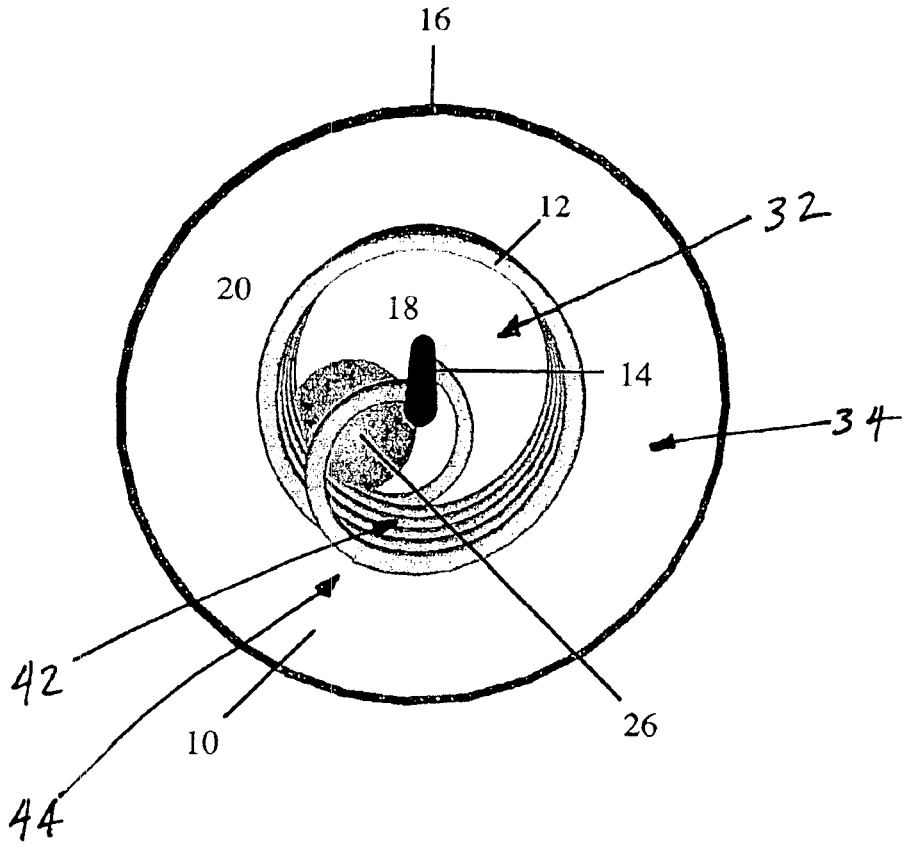

FIG. 2 is a plan view of the dual path helical ramp

Figure 3:
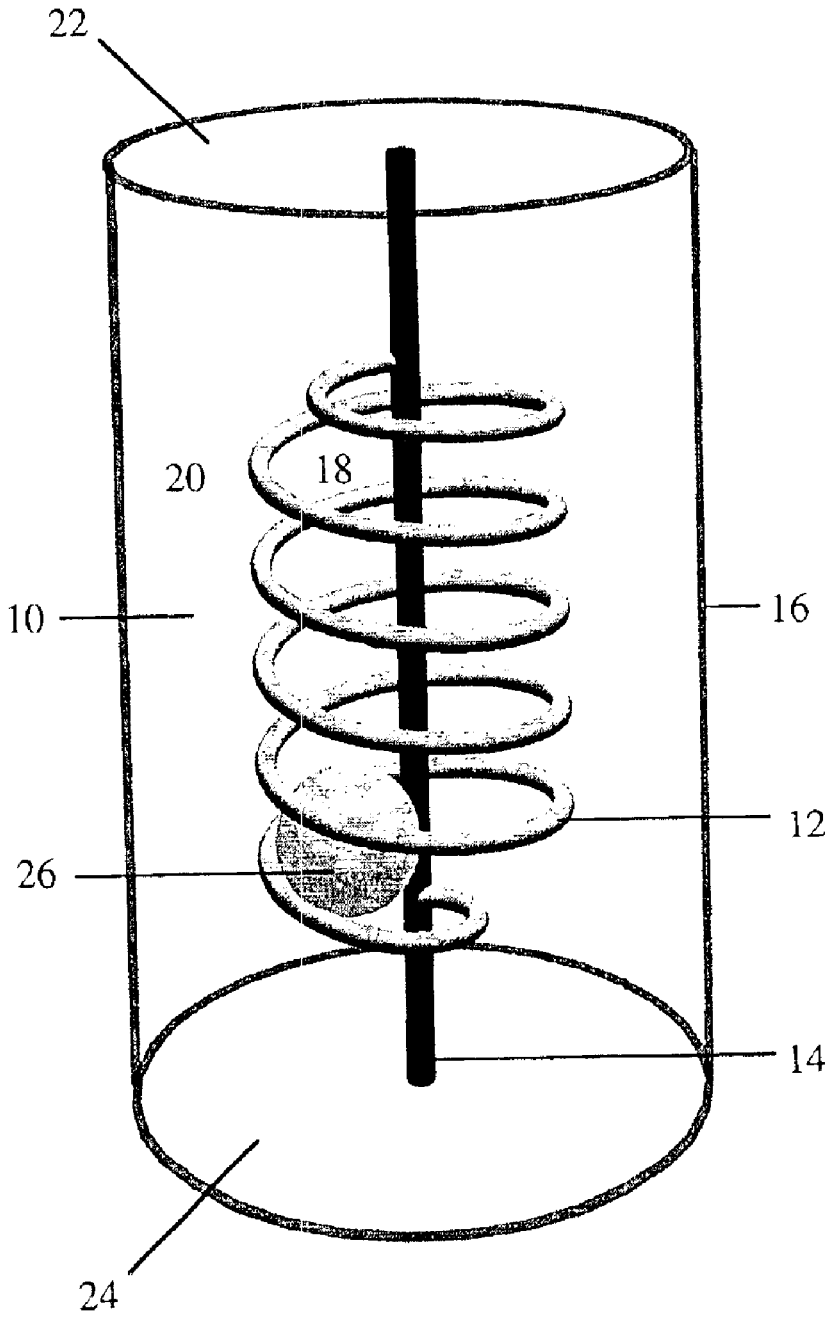

FIG. 3 is a perspective view of the dual path helical ramp, illustrating the interior path.

Figure 4:
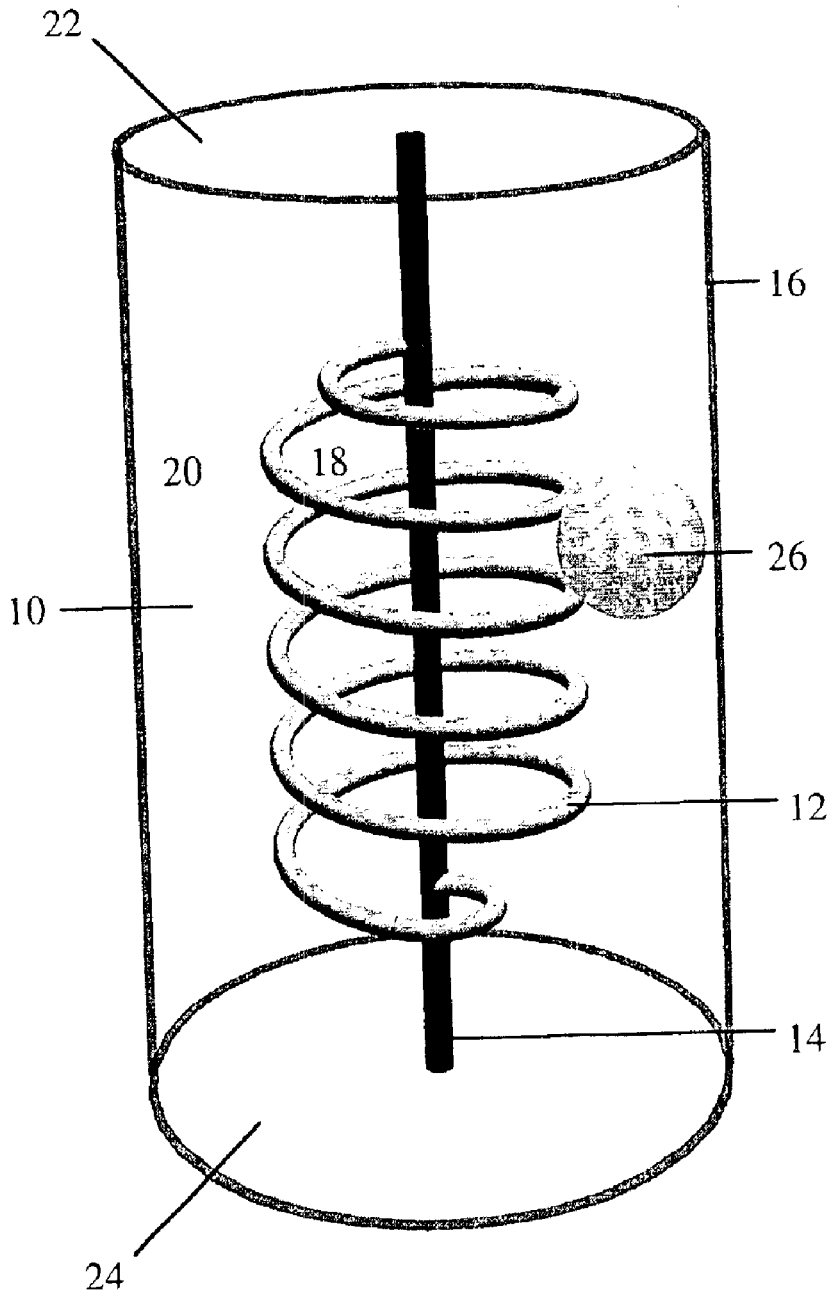

FIG. 4 is a perspective view of the dual path helical ramp, illustrating the exterior path.

The same reference numerals refer to the same parts through the various Figures.

DETAILED DESCRIPTION OF THE INVENTION

With reference now to the drawings, FIGS. 1–4, the dual path helical ramp will be described: As shown in FIG. 1, a wire rail formed as a helix 12, a straight rail 14, a closed transparent cylindrical wall rail 16, and a ball 26. The helical rail 12 extends between a first elevation 22 where the ball enters or exits the ramp to a second, lower elevation 24 where a ball exits or enters the ramp. The straight rail 14 extends through the center of the helical rail 12 for the length thereof. The cylindrical wall rail 16 extends outside of the helical rail 12 for the length thereof. The helical rail 12 is joined at either end of the straight rail 14 and the straight rail 14 is joined at either end of the cylindrical wall rail 16, thereby forming two elevations, 22 and 24. As shown in FIG. 2, the helical rail 12 is dimensioned such that distance between it and straight rail 14 and it and wall rail 16 is less than the diameter of the ball 26. As a result, the ball 26 will contact both helical rail 12 and straight rail 14, or helical rail 12 and wall rail 16, simultaneously, as it rolls downward by the force of gravity, and upward by taking advantage of the centrifugal force of the ball, using suitable circular movements. As shown in FIG. 3 and FIG. 4, Each elevation, 22 and 24, has sufficient space for the ball 26 to cross from one path 18 to the other 20, allowing the ball 26 to roll up and a continuous helical path, along linked concentric interior and exterior paths of the dual path helical ramp 10, as the device is manipulated about its three-dimensional axes.

FIG. 1 shows generally two entrance points for the ball 26 to travel along an interior helical path 32 or an exterior helical path 34 (paths best seen in FIG. 2). The interior path entrance point 42 allows the ball 26 to travel along the interior path 32, while the exterior entrance point 44 allows the ball 26 to travel along the exterior path 34. Each path has a corresponding exit point, an interior exit point 52 and an exterior exit point 54. As has already been described generally, when the ball 26 travels down either of the paths 32, 34 due to the force of gravity, it transitions from one exit point 52, 54 to another 52, 54, and begins an upward travel along the other path 32, 34.

As to the manner of usage and operation of the present invention, the same should be apparent from the above description. Accordingly, no further discussion relating to the manner of usage and operation will be provided.

With respect to the above description, the optimum dimensional relationships for the parts of the invention, to include variation in size, opacity, materials, shape, form, function and the manner of operation, assembly and use, are deemed readily apparent and obvious to one skilled in the art, and all equivalent relationships to those illustrated in the drawings and described in the specification are intended to be encompassed by the present invention.

What I claim is:

1. A dual helical ramp toy comprising:

a helical rail formed around a longitudinal axis, the longitudinal axis coincident with a substantially straight rail;

an open-ended cylindrical wall oriented about the longitudinal axis, the cylindrical wall enclosing the helical rail and the straight rail; and a ball sized and shaped to follow a first interior helical path between the helical rail and the straight rail, and a second exterior helical path between the helical rail and the cylindrical wall.

2. The dual helical ramp toy of claim 1 having a first elevation higher than a second elevation when the longitudinal axis is oriented substantially perpendicular to a level surface, the first elevation comprising an interior path entrance point and exterior path entrance point, the entrance points providing ball access to the interior helical path and exterior helical path respectively.

3. The dual helical ramp toy of claim 2 wherein the second elevation comprises an interior path exit point and exterior path exit point, the exit points providing a ball exit from the interior helical path and exterior helical path respectively.

4. The dual helical ramp toy of claim 3 further comprising a closed end portion that closes an end of the cylindrical wall, the closed end portion located adjacent the exit points, the ball sized to move between the respective exit points along the closed end portion.

5. The dual helical ramp toy of claim 4 wherein the ball travels along one of said paths from the path's entrance point to the path's exit point under the force of gravity, and at the path's exit point, the ball moves from one of said paths to the other of said paths and travels along said other path under centrifugal force generated during the ball's travel along the one of said paths.

6. The dual helical ramp toy of claim 4 wherein when the ball exits at an exit point, rotation of the toy in a manner that flips the longitudinal axis substantially 180 degrees results in the ball traveling along either:

the interior helical path between the interior exit point and the interior path entrance point; or the exterior path between the exterior exit point and the exterior path entrance point;

wherein the ball can be retrieved by a user at the entrance point.

7. The dual helical ramp toy of claim 2 wherein the cylindrical wall is transparent.

8. A dual helical ramp toy comprising:

a helical rail formed around a longitudinal axis, the longitudinal axis coincident with a substantially straight rail;

a cylinder oriented about the longitudinal axis, the cylinder enclosing the helical rail and the straight rail around the longitudinal axis, at least one cylinder round end portion rigidly engaged to an end of the substantially straight rail; and a ball sized and shaped to follow a first interior helical path between the helical rail and the straight rail, and a second exterior helical path between the helical rail and an interior surface of the cylinder.

9. The dual helical ramp toy of claim 8 having a first elevation higher than a second elevation when the longitudinal axis is oriented substantially perpendicular to a level surface, the first elevation comprising an interior path entrance point and exterior path entrance point, the entrance points providing ball access to the interior helical path and exterior helical path respectively.

10. The dual helical ramp toy of claim 9 wherein the second elevation comprises an interior path exit point and exterior path exit point, the exit points providing a ball exit from the interior helical path and exterior helical path respectively.

11. The dual helical ramp toy of claim 10 further comprising a closed end portion that closes an end of the cylinder, the closed end portion located adjacent the exit points, the ball sized to move between the respective exit points along the closed end portion.

12. The dual helical ramp toy of claim 11 wherein the ball travels along one of said paths from the path's entrance point to the path's exit point under the force of gravity, and at the path's exit point, the ball moves from one of said paths to the other of said paths and travels along said other path under centrifugal force generated during the ball's travel along the one of said paths.

13. The dual helical ramp toy of claim 8 wherein the cylinder is transparent.

* * * * *